US006003609A

United States Patent [19]

Walls

[11] Patent Number: 6,003,609

[45] Date of Patent: Dec. 21, 1999

[54] FIRE SAFETY DEVICE

[76] Inventor: Craig Walls, 736 E. Park Ave., Greenwood, Ind. 46142

[21] Appl. No.: 09/126,730

[22] Filed: Jul. 31, 1998

Related U.S. Application Data

[60] Provisional application No. 60/054,395, Jul. 31, 1997.

[51] Int. Cl.[6] ..... A62C 35/10; A62C 37/00

[52] U.S. Cl. ..... 169/57; 169/29

[58] Field of Search ..... 169/54, 56, 57, 169/60, 26, 29; 340/628

[56] References Cited

U.S. PATENT DOCUMENTS

| | | | |
|---|---|---|---|
| 3,587,780 | 6/1971 | Romero | 169/26 |
| 3,820,607 | 6/1974 | Miley | 169/26 X |
| 4,006,780 | 2/1977 | Zehr | 169/26 |
| 4,088,192 | 5/1978 | Lamond | 169/19 |
| 4,299,289 | 11/1981 | Kato | 169/57 |
| 4,730,182 | 3/1988 | Tsubouchi | 340/593 |
| 4,805,701 | 2/1989 | Mountford | 169/57 |
| 5,016,715 | 5/1991 | Alasio | 169/26 X |
| 5,315,292 | 5/1994 | Prior | 340/628 |
| 5,361,847 | 11/1994 | Phelps | 169/26 X |
| 5,551,517 | 9/1996 | Arsenault et al. | 169/57 |
| 5,808,541 | 9/1998 | Golden | 169/26 X |

*Primary Examiner*—Lesley D. Morris
*Attorney, Agent, or Firm*—Richard C. Litman

[57] ABSTRACT

A fire safety device for controlling the spread of fire in a structure. The invention comprises a base plate, a smoke detector, a syringe, and a cover. The syringe has a reservoir containing a fire retardant chemical. A fuse link holder has a melting fuse link that maintains a plunger assembly in position, and a spring is loaded behind the plunger. The syringe also has a nozzle in open communication with a supply line, which is in open communication to the reservoir. When a sufficiently high ambient temperature is reached, the fuse link melts, releasing the piston rod from the fuse link and allowing the coil spring to urge the plunger toward the other end of the syringe, and forcing the fire-retardant chemical from the nozzle. When smoke is present, the smoke detector sounds an audible alarm.

7 Claims, 2 Drawing Sheets

FIRE SAFETY DEVICE

CROSS-REFERENCE TO RELATED APPLICATION

This application claims the benefit of U.S. Provisional Patent Application Ser. No. 60/054,395, filed Jul. 31, 1997.

BACKGROUND OF THE INVENTION

1. Field of the Invention

The present invention relates to a device for containing fires and, more particularly, to a device that sprays a fire-retardant chemical upon the melting of a heat-sensitive fuse link.

2. Description of Related Art

Fire control devices have been widely used in the past to save lives and property. Such devices are well known in the art. One such device is described in U.S. Pat. No. 3,587,747 which issued to M. A. Romero et al. on Mar. 7, 1969. This invention is a fire extinguisher having a normally closed discharge valve that is maintained in the closed position by a loaded spring, and opens upon the melting of a fusible link. Similarly, U.S. Pat. No. 4,006,780 which issued to W. J. Zehr on Feb. 8, 1977 discloses a device for rupturing a pressurized cylinder containing a fire-extinguishing product. A fusible link maintains a spring-loaded punch in loaded position, and when the temperature is high enough to melt the fusible link, the spring urges the punch forth to rupture the cylinder, thereby discharging the contents therefrom.

U.S. Pat. No. 4,088,192 which issued to L. Lamond on May 9, 1978, discloses a heat-activated plunger. The plunger is slidably mounted in a passage, and slides forward upon the melting of a fusible link to release the contents of a fire extinguisher.

U.S. Pat. No. 4,299,289 which issued to K. Kato on Nov. 10, 1981, discloses a fire extinguisher having a heat fusible member under compression. When the room temperature rises above a predetermined value, the heat fusible member releases a striker that breaks the seal on a tank containing a fire extinguishing solution.

U.S. Pat. No. 4,730,182 which issued to S. Tsubouchi on Mar. 8, 1988 discloses a combination heat-sensing fire detector. The detector has a differential diaphragm and a contact which operates at a predetermined temperature. Also included is a shape-memory alloy coil. When the ambient temperature rises rapidly, the contact is closed by deformation of the diaphragm, and when the ambient temperature rises slowly, the shape memory alloy coil extends to close the contact, thereby generating an alarm.

U.S. Pat. No. 4,805,701 which issued to G. S. Mountford on Feb. 21, 1989, discloses a fire extinguisher and alarm apparatus for use with a container of combustible materials. The apparatus has a temperature sensitive device which softens in the presence of heat and a valve responsive to the softening of the temperature sensitive device. Upon sensing heat, the apparatus is actuated in order to eject fire extinguishing liquid from the apparatus in order to extinguish the fire without sufficient velocity to blow burning materials from the cavity of the container, and simultaneously to actuate an audible alarm to warn of fire.

U.S. Pat. No. 5,315,292 which issued to M. K. Prior on May 24, 1994, discloses a ceiling mountable smoke detector and fire extinguisher combination having a heat-sensing switch. Upon sensing heat, this switch closes to allow the activation and opening of a valve, at which point fire retardant is dispersed in the immediate area. This device is unreliable in that it relies on AC power, and may not function if electricity has been interrupted.

U.S. Pat. No. 5,551,517 which issued to J. A. Arsenault et al. on Sep. 3, 1996, discloses an automatic fire extinguishing valve capable of attachment to a fire extinguisher to enable the automatic discharge of the fire extinguishing chemical therefrom. The valve is controlled by a temperature sensitive trigger mechanism in opposition to a loaded spring that is in turn attached to a puncturing device. When the mechanism is triggered, the spring urges the puncturing device, thereby releasing the contents of the fire extinguisher.

None of the above inventions and patents, taken either singly or in combination, is seen to describe the instant invention as claimed.

SUMMARY OF THE INVENTION

The present invention provides a fire safety device for controlling the spread of fire in a structure. The invention comprises a base plate, a smoke detector, a syringe, and a cover. The syringe has a reservoir containing a fire retardant chemical. A fuse link holder has a melting fuse link that maintains a plunger assembly in a normal position. The plunger assembly comprises a piston that slides within the syringe, and a piston rod having one end coaxially mounted to the piston and the other end mounted to the melting fuse link. A spring is loaded behind the piston and about the piston rod for urging the plunger assembly into an activated position. The syringe also has a nozzle in open communication with a supply line, which is in open communication to the reservoir.

When a sufficiently high ambient temperature is reached, the fuse link melts, releasing the piston rod from the fuse link and allowing the coil spring to urge the plunger toward the activated position. The fire-retardant chemical is discharged from the reservoir, passing through the supply line and nozzle to produce a mist of fire-retardant chemical which is sprayed over the surrounding area. Further, when smoke is present, the smoke detector sounds an audible alarm. The portability and ease of use of the present invention make it desirable for use in the home and while traveling.

Accordingly, it is a principal object of the invention to provide a fire safety device that may quickly and easily control the spread of a fire.

It is another object of the invention to provide a fire safety device that may be easily and quickly installed to virtually any surface.

Still another object of the invention is to provide a fire safety device which does not require maintaining a pressured source of fire retardant chemicals.

It is a further object of the invention to provide a fire safety device that does not rely on AC power, thereby increasing reliability in the event of an emergency.

Still another object of the invention is to provide a fire safety device that may be easily and inexpensively manufactured.

It is an object of the invention to provide improved elements and arrangements thereof in an apparatus for the purposes described which is inexpensive, safe, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
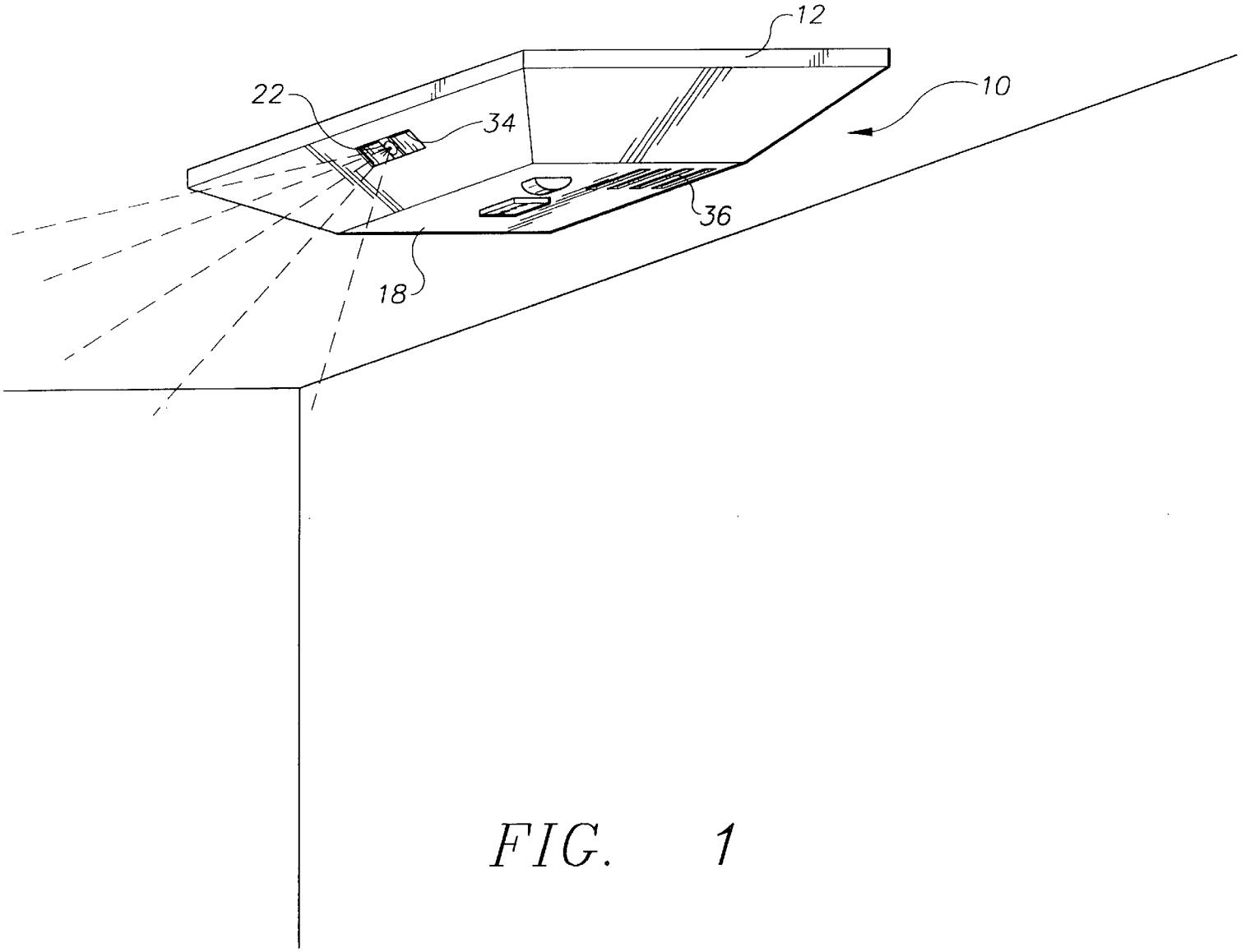
FIG. 1 is an environmental perspective view of the fire safety device according to the preferred embodiment of the present invention.
Figure 2:
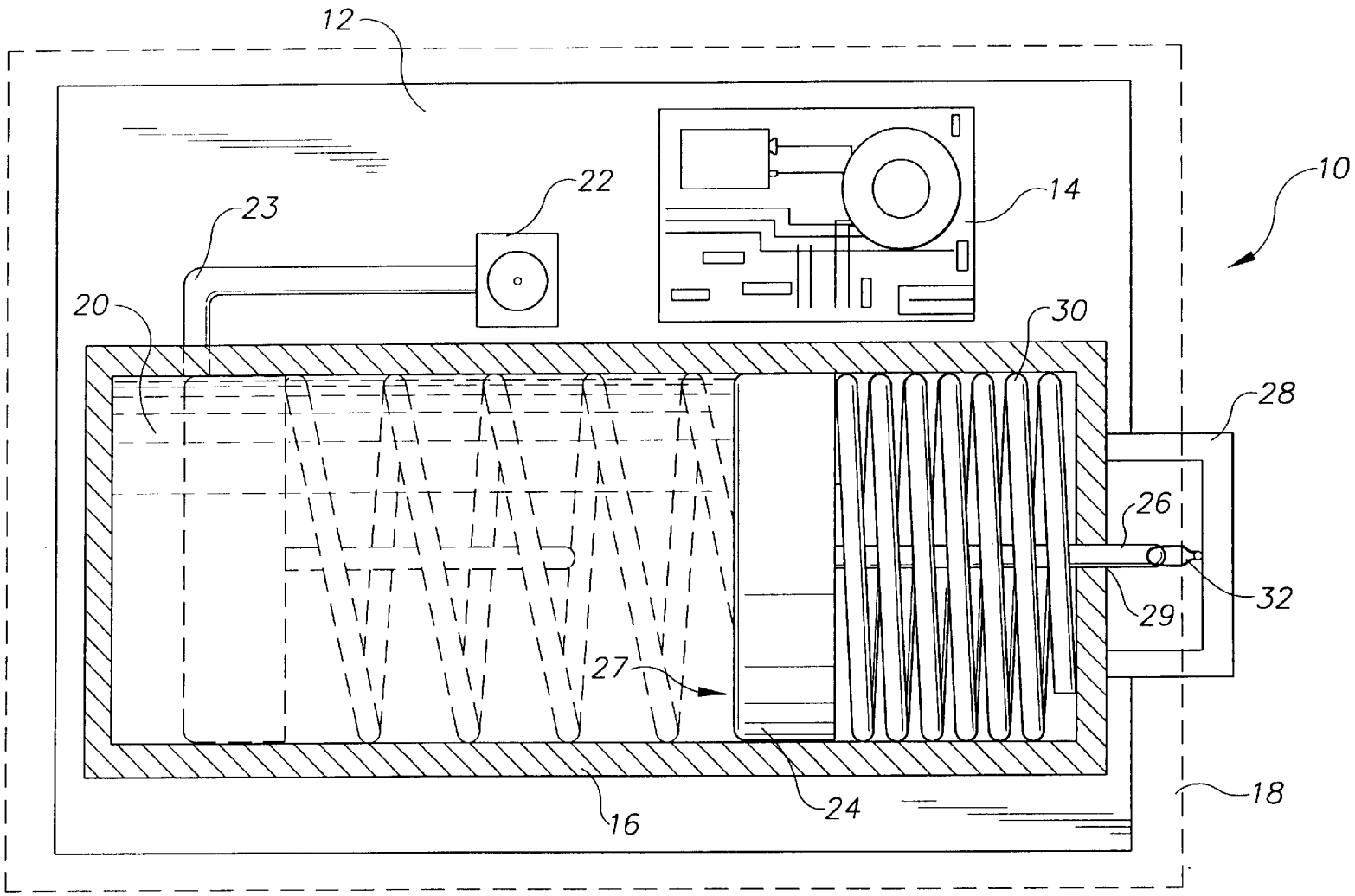
FIG. 2 is a plan view of the present invention, showing the case in phantom lines.

Referring now to the drawings wherein like numerals represent like elements, FIGS. 1 and 2 show a fire safety device 10 according to a preferred embodiment of the present invention. The fire safety device 10 comprises a base plate 12, a smoke detector 14, a syringe 16, and a cover 18. The smoke detector 14 and syringe 16 are secured to the base plate 12, and the cover 18 is removably mounted to the base plate to enclose the smoke detector and syringe. The smoke detector 14 and the syringe 16 are secured to the base plate 12 using any conventional means which are well known in the art. Likewise, the cover 18 is removably mounted to the base plate using any conventional means which are well known in the art. The smoke detector 14 is of a conventional design well known in the art and capable of being built using commonly available components, therefore no further discussion of the smoke detector is deemed necessary.

The syringe 16 includes a plunger assembly 27 mounted within the syringe and secured in a normal position at one end thereof so as to define a reservoir 20. The reservoir is defined generally by the walls of the syringe and the plunger assembly positioned within the one end of the syringe. The reservoir 20 contains a fire-retardant chemical intended for discharge from the syringe 16 when the plunger assembly 27 is released from its normal position and urged toward an activated position, as described more fully hereinafter. Connected to the other end of the syringe 16 is a supply line 23 which is in open communication with the reservoir 20 and a nozzle 22.

The plunger assembly 27 includes a piston 24 having front and rear faces, and a piston rod 26 connected to and extending from the rear face of the piston. The piston 24 is configured for axially sliding within the syringe 16 so as to maintain a seal between the piston 24 and the inner walls of the syringe. In its preferred form, the syringe 16 is cylindrical and the piston 24 has a suitable diameter. The piston rod 26 is coaxially connected to the rear face of the piston 24. When the plunger assembly 27 is in the normal position, a free end of the piston rod 26 extends through a rod-receiving aperture 29 present at the one end of the syringe 16.

A fuse link holder 28 is attached externally of the one end of the syringe 16. A fuse link 32 is provided intermediate the end of the piston rod 26 and the fuse link holder 28. The fuse link 32 is responsible for retaining the piston rod 26 in the normal position. A coil spring 30 is coiled about the piston rod 26 and positioned intermediate the piston 24 and the one end of the syringe 16. As shown in FIG. 2, the coil spring 30 is compressed while the plunger assembly 27 is retained in the normal position by the fuse link 32. The fuse link 32 prevents the loaded coil spring 30 from urging the plunger assembly 27 toward the other end of the syringe when the ambient temperature is below a threshold temperature. When the ambient temperature reaches approximately 159° F., the fuse link 32 will melt. In the preferred embodiment, the fuse link may be constructed of a well-known melting alloy, but may comprise other materials in alternative embodiments.

When the fuse link 32 melts, the piston rod 26 is released from the fuse link and the coil spring 30 urges the plunger assembly 27 toward the other end of the syringe 16. As the plunger assembly moves from the normal position toward the activated position, as indicated by the broken lines in FIG. 2, the plunger 24 applies pressure upon the supply of fire-retardant chemical, thereby forcing the fire-retardant chemical from the reservoir 20 for discharge through the supply line 23 and nozzle 22. The nozzle 22 preferably discharges the fire-retardant chemical in the form of a mist which is sprayed over the surrounding area.

In the preferred embodiment, the fire-retardant chemical used is Fire Barrier II®, a Class A fire retardant (manufactured by Fire Doctor of Pemberton, N.J.) which is a UL®-approved, nontoxic, hypoallergenic chemical. However, other and/or additional retardants (e.g., Class B and/or C) may be used in alternative embodiments.

The cover 18 has a nozzle aperture 34 that allows the nozzle 22 to communicate with ambient air. The cover 18 additionally has a vent 36 to allow heat to penetrate the cover to melt the fuse link 32, and to further allow smoke to penetrate the cover to trigger the smoke detector 14.

It is to be understood that the present invention is not limited to the embodiment described above, but encompasses any and all embodiments within the scope of the following claims.

I claim:

1. A fire safety device comprising:

a base plate for mounting to a surface;

smoke detection means for detecting smoke, said smoke detection means being secured to said base plate; and a syringe having opposed ends, said syringe being secured to said base plate and comprising a plunger assembly positioned within said syringe;

said plunger assembly including:

a piston having front and rear faces and being slidable within said syringe, said front face of said piston defining a reservoir within said syringe, and a piston rod coaxially connected to said rear face of said piston, said piston rod having a free end;

retaining means for releasably retaining said plunger assembly in a normal position with said plunger assembly at one said end of the syringe;

urging means for urging said plunger assembly to move from the normal position into an activated position upon release of said retaining means; and a nozzle in open communication with said reservoir at another said end of said syringe.

2. The fire safety device according to claim 1 wherein said urging means comprise a coil spring positioned about said piston rod and mounted intermediate said piston and the one end of said syringe, said coil spring constantly exerting sufficient force capable of urging said plunger assembly toward the activated position.

3. The fire safety device according to claim 1 wherein said retaining means comprise:

a fuse link holder present on the one end of said syringe; and a fuse link connected to said fuse link holder and the free end of said piston rod, said fuse link melting at a threshold temperature; and whereupon the melting of said fuse link results in said urging means urging said plunger assembly toward the other end of said syringe into the activated position.

4. The fire safety device according to claim 1 further comprising:

a cover removably mounted to said base plate enclosing the contents mounted to said base plate, said cover having a nozzle aperture, thereby exposing said nozzle to ambient;

ventilation means present on said cover; and mounting means for mounting said cover to said base plate.

5. The fire safety device according to claim 1, further comprising a fire-retardant chemical contained within said reservoir.

6. A fire safety device comprising:

a base plate for mounting to a surface;

smoke detection means for detecting smoke, said smoke detection means being secured to said base plate; and a syringe having opposed ends, said syringe being secured to said base plate and comprising a plunger assembly positioned within said syringe;

said plunger assembly including:

a piston having front and rear faces and being slidable within said syringe, said front face of said piston defining a reservoir within said syringe, and a piston rod coaxially connected to said rear face of said piston, said piston rod having a free end;

a coil spring positioned about said piston rod and mounted intermediate said piston and one said end of said syringe, said coil spring constartly exerting sufficient force capable of urging said plunger assembly toward the other end of said syringe;

a fuse link holder present on the one end of said syringe;

a fuse link connected to said fuse link holder and said free end of said piston rod, said fuse link retaining the plunger assembly in a normal position with said plunger assembly at the one end of said syringe, said fuse link melting at a threshold temperature;

a nozzle in open communication with said reservoir at another said end of said syringe; and whereupon the melting of said fuse link results in said urging means urging said plunger assembly toward the other end of said syringe into the activated position.

7. The fire safety device according to claim 6, further comprising a fire-retardant chemical contained within said reservoir.

* * * * *